US008701289B2

(12) United States Patent
Paulik et al.

(10) Patent No.: US 8,701,289 B2
(45) Date of Patent: Apr. 22, 2014

(54) PROCESS FOR PRODUCING A TURBULENCE APPARATUS

(75) Inventors: Jens Paulik, Korntal-Münchingen (DE); Jürgen Hägele, Stuttgart (DE); Werner Oswald, Horb a.N. (DE); Achim Utz, Waiblingen (DE)

(73) Assignee: Behr GmbH & Co. KG, Stuttgart (DE)

( * ) Notice: Subject to any disclaimer, the term of this patent is extended or adjusted under 35 U.S.C. 154(b) by 918 days.

(21) Appl. No.: 12/680,789

(22) PCT Filed: Oct. 1, 2008

(86) PCT No.: PCT/EP2008/008310
§ 371 (c)(1),
(2), (4) Date: Mar. 30, 2010

(87) PCT Pub. No.: WO2009/049771
PCT Pub. Date: Apr. 23, 2009

(65) Prior Publication Data

US 2010/0218922 A1 Sep. 2, 2010

(30) Foreign Application Priority Data

Oct. 9, 2007 (DE) ..... 10 2007 048 474

(51) Int. Cl.
*B21D 53/02* (2006.01)

(52) U.S. Cl.
USPC ..... 29/890.03; 29/727; 72/197; 165/174; 428/604

(58) Field of Classification Search
USPC ..... 29/890.03, 726, 726.5, 727; 72/197; 165/174, 148; 428/604
See application file for complete search history.

(56) References Cited

U.S. PATENT DOCUMENTS 3,421,353 A 1/1969 Franc
4,047,417 A 9/1977 Oser et al.
(Continued)

FOREIGN PATENT DOCUMENTS

DE 4028438 12/1994
DE 20102056 6/2001
(Continued)

OTHER PUBLICATIONS

Machine Translation of DE 10 2008 015064 A1.*

*Primary Examiner* — Sarang Afzali
(74) *Attorney, Agent, or Firm* — Bachman & LaPointe, P.C.

(57) ABSTRACT

A process for producing a turbulence device (1) which is to be mounted in at least one flow duct of a heat exchanger of a motor vehicle includes the steps of, in a first process step, at least one shaping operation is used to produce at least one substantially meandering turbulence device (30) with substantially smooth walls (2) from a substantially continuously planar sheared strip (9), wherein a longitudinal direction (RLR) of the walls runs substantially parallel to a forward feed direction (VSR) of the sheared strip (9), and in a second process step, wall sections are deformed at least by an angle (α) in relation to the forward feed direction (VSR), in such a way that undercuts (3) are produced in relation to the forward feed direction (VSR, RLR), wherein the substantially continuously planar sheared strip (9) is cut into turbulence devices (1) of predetermined lengths before carrying out the second process step.

15 Claims, 7 Drawing Sheets

(56) References Cited

U.S. PATENT DOCUMENTS

| | | | | |
|---|---|---|---|---|
| 4,753,096 | A * | 6/1988 | Wallis | 72/196 |
| 5,201,367 | A | 4/1993 | Dubrovsky et al. | |
| 5,441,106 | A | 8/1995 | Yukitake | |
| 5,979,050 | A * | 11/1999 | Counterman et al. | 29/890.034 |
| 6,591,647 | B2 | 7/2003 | Gerard | |
| 6,622,785 | B2 | 9/2003 | Haegele et al. | |
| 2005/0016240 | A1 * | 1/2005 | Zurawel et al. | 72/177 |

FOREIGN PATENT DOCUMENTS

| | | |
|---|---|---|
| DE | 10212799 | 9/2003 |
| DE | 102006031675 | 1/2008 |
| DE | 102008015064 | 9/2008 |
| GB | 2346105 | 8/2000 |

* cited by examiner

PROCESS FOR PRODUCING A TURBULENCE APPARATUS

BACKGROUND OF THE INVENTION

The present invention relates to a process for producing a turbulence device which is to be mounted in at least one flow duct of a heat exchanger of a motor vehicle, comprising the following process steps: in a first process step, at least one shaping operation is used to produce at least one substantially meandering turbulence device with substantially smooth walls from a substantially continuously planar sheared strip, wherein a longitudinal direction of the walls runs substantially parallel to a forward feed direction of the sheared strip. In a second process step, wall sections are deformed at least by an angle $\alpha$ in relation to the forward feed direction, in such a way that undercuts are produced in relation to the forward feed direction.

The invention further relates to an apparatus for carrying out a process as described herein, comprising at least one set of rollers for successively shaping the sheared strip, in particular the sheet-metal blank into a substantially meandering turbulence device with substantially smooth walls, at least one apparatus with roller stamping dies for deforming the wall sections at least by an angle $\alpha$ in relation to the forward feed direction, in such a way that undercuts are produced in relation to the forward feed direction, and at least one apparatus for cutting the turbulence device to a predetermined length.

The present invention further relates to a turbulence device produced by a process as described herein.

DESCRIPTION OF THE RELATED ART

In heat exchangers for motor vehicles, such as automobiles or commercial vehicles, for example, the charge air which is delivered to the engine may, where necessary, be cooled by means of a heat exchanger, such as a charge air cooler, for example. A proportion of the recirculated exhaust gas, which is returned to the charge air, for example, is furthermore also cooled by means of a heat exchanger, such as an exhaust gas cooler, for example. The charge air and/or the exhaust gas may also be cooled in one heat exchanger, which represents a combination of a charge air cooler and an exhaust gas cooler.

In order to increase the heat transfer efficiency, turbulence devices such as corrugated fins, for example, in particular internal corrugated fins, are arranged in the flow ducts of the heat exchanger, in particular the intercooler and/or the exhaust gas cooler. For this purpose the corrugated fins are introduced, for example pushed or injected, into the flow ducts, in particular the tubes.

The fins must be optimized so as to increase the desired heat transfer efficiency on the one hand and so as to minimize the pressure drop on the other.

Such a turbulence device is represented, for example, in the unpublished DE 10 2007 014 138.8. The fins here have a substantially meandering structure, a substantially corrugated structure being superimposed on this meandering structure in plane offset by 90.

Impressions are furthermore introduced into the walls, so that flow passage openings can be formed. These impressions are introduced in a plane substantially perpendicular to the longitudinal direction of the turbulence device. In this way undercuts are produced in the direction of a plane, which is substantially perpendicular to the longitudinal direction of the turbulence plane.

DE 102 12 799 C1 discloses a metal hollow chamber profile for heat exchangers. On the outside the hollow chamber profile has cooling fins, which are deformed transversely to the longitudinal extent of the basic profile. In this case, however, the cooling fins are offset from those of the basic profile. For this purpose a comb-like deforming tool is mounted on the profile and all adjacent cooling fins are simultaneously subjected to a corresponding deformation force.

DE 102 12 300 A1 discloses a seamed, multi-chamber flat tube. This is a closed profile, which possesses greater strength than an open structure of a turbulence device, which is then pushed into a tube. The seamed, multi-chamber flat tube in DE 102 12 300 A1 is produced by means of a continuous production process, such as rotary stamping, for example. Slits are cut or stamped into a flat sheared strip. Here the openings are stamped in phase on a separate tool station before feeding the smooth strip to the tube-forming machine. Stamping therefore takes place prior to forming of the tube.

DE 201 02 056 U1 discloses an apparatus for producing sheet-metal parts for air conditioning ducts. Here a sheared strip is wound off from a coil and, subjected to gradual shaping in the continuous or virtually continuous pass, is transformed into a continuous fin. The trapezoidal profile is merely smooth. The sheared strip is then cut off in a shear unit and only then is the beaded sheared strip bent to form a duct.

Producing a fin by means of a stamping process is also known. In this case, however, the production times are long and the production costs correspondingly high. In addition a separate tool has to be procured for each fin length. Replacement tools furthermore have to be kept in readiness.

Producing turbulence devices, such as internal corrugated fins, for example, by a cross-rolling process is furthermore known. Owing to the limited length, in such a process multiple short turbulence devices may possibly have to be produced, which then have to be introduced individually into the tubes of the heat exchangers. This similarly gives rise to long production times and high production costs, particularly due to the assembly process. Producing the smooth part of the fin by means of a longitudinal rolling process and then introducing the offset transversely to the longitudinal direction of the fin together with any cuts for passage openings by means of a subsequent stamping process is also known. The processes have different cycle times, however, so that the more time-consuming stamping process, in particular, takes longer than the longitudinal rolling process for producing the preliminary stage of the turbulence device with merely smooth walls. Owing to the thin basic material, the process of cutting the turbulence devices to any predetermined, freely selectable length is particularly difficult, since the areas in which a cut is made through the turbulence device has to be precisely fixed, in order to obtain a precise cut substantially without any cutting burrs, since the cutting burrs reduce the heat transfer efficiency and increase the pressure loss. The facility for such cutting to length should be feasible anywhere on the turbulence device. The complex structure of the turbulence device with undercuts and offsets makes this cutting operation problematical.

SUMMARY OF THE INVENTION

The object of the present invention is to improve a process for producing a turbulence device for insertion into a heat exchanger. In particular the object of the present invention is to provide a process in which turbulence devices of any predetermined length and with a substantially meandering profile, which has cuts and/or offsets and impressions substantially transversely to the longitudinal direction of the turbulence device, to produce substantially without cutting burrs at the cutting sites.

This object is achieved by the features of the invention disclosed herein.

An inventive process is provided for producing a turbulence device which is to be mounted in at least one flow duct of a heat exchanger, in particular a charge air cooler and/or an exhaust gas cooler, of a motor vehicle. The process in this case comprises the following process steps:

In a first process step at least one shaping operation is used to produce at least one substantially meandering turbulence device with substantially smooth walls from a substantially continuously planar sheared strip, wherein a longitudinal direction of the walls runs substantially parallel to a forward feed direction of the sheared strip. In a second process step, wall sections are deformed at least by an angle $\alpha$ in relation to the forward feed direction, in such a way that undercuts are produced in relation to the forward feed direction. The substantially continuous sheared strip is cut into turbulence devices of predetermined length before carrying out the second process step.

In an advantageous development of the invention cutting to length is performed prior to the first process step. In this way the length of the turbulence device can be already produced before forming the meandering structure. This is particularly advantageous in simplifying the die fixing for a precise cut.

In an advantageous development of the invention cutting to length is performed between the first process step and the second process step. In this way cutting to length is performed as late as possible, so that subsequent deforming operations no longer have any effects on the cut edge, which is particularly advantageous in being able to avoid inaccuracies.

In a particularly advantageous development of the invention at least one cut is introduced into the meandering turbulence device prior to the deformation of the wall sections. The cut is introduced, in particular, at an angle $\beta$. The angle $\beta$ has an influence, in particular, on the profile of the cut edge of the undercuts in relation to the rolling direction. This is particularly advantageous in being able to introduce deformations into the turbulence device, for example openings for the passage of a flow of fluid in which a turbulence is generated, such as charge air and/or exhaust gas, for example, or a coolant, such as air, for example. In this way the turbulence of the fluid and in particular, therefore, the heat transfer is increased for an acceptable increase in the pressure loss.

In a particularly advantageous development the angle a and/or the angle $\beta$ assume values from 0° to 90°, in particular from 0.5° to 80°.

In a particularly advantageous development of the invention the first process step is a rolling process, in particular a longitudinal rolling process. This makes it possible to produce turbulence devices, in particular fins, of any predeterminable length.

In an advantageous development of the invention the first process step has and comprises 2 to 40 intermediate steps, in particular 2 to 35 intermediate steps, in particular 2 to 30 intermediate steps. In the intermediate steps the sheared strip is successively machined in such a way that the width of the substantially smooth turbulence device thus produced has a smaller turbulence device width than in the preceding intermediate step. In this way the sheared strip is gently machined, in particular shaped, so that the meandering structure emerges gradually and the sheet metal thickness of the overall turbulence device produced is substantially uniform, so that in particular no unwanted cracks and thin points occur in the material.

In a particularly advantageous development of the invention the intermediate steps are longitudinal rolling process steps. This is particularly advantageous in ensuring that turbulence devices can be fabricated in any predeterminable length.

In an advantageous development of the invention the turbulence device has a sheet metal thickness from 0.05 mm to 0.35 mm, in particular from 0.05 mm to 0.25 mm, in particular from 0.06 mm to 0.2 mm, in particular from 0.06 to 0.15 mm. The use of thin material is a particularly advantageous way of saving material and in this way of saving valuable raw material, and is particularly advantageous in reducing costs.

In an advantageous development of the invention strip material for the sheared strip is wound off from a coil and is then led that the strip material is substantially planar. This is particularly advantageous as a space-saving way of storing the strip material whilst still making substantially planar strip material available for the formation of the turbulence device.

According to the invention an apparatus is furthermore provided for carrying out a process as disclosed herein. The apparatus comprises at least one set of rollers for successively shaping the sheared strip into a substantially meandering turbulence device with substantially smooth walls. At least one apparatus with roller stamping dies, which may comprise from one to four pairs of rollers for deforming the wall sections at least by an angle $\alpha$ in relation to the forward feed direction, in such a way that undercuts are produced in relation to the forward feed direction. At least one apparatus for cutting the turbulence device to a predetermined length provided. The apparatus for cutting to length is connected to the outlet side of the set of rollers and the inlet side of the roller stamping dies. In another embodiment the apparatus for carrying out the process is configured in such a way that the apparatus for cutting to length is connected to the inlet side of the roller stamping die.

In an advantageous development of the invention a take-off reel stores strip material to be processed and/or a dancer element is arranged between a strip inlet station, particularly for guiding in rollers and for orientation and tensioning and for avoiding shafts and the take-off reel. This is particularly advantageous in feeding the strip material, wound up as a coil, to a strip inlet apparatus.

In an advantageous development of the invention a transfer station is assigned to the outlet side of the station with the roller stamping dies for transferring the finished turbulence device to a further station, in particular an assembly station for fitting the turbulence device into at least one heat exchanger tube. This is a particularly advantageous way, following their production, of allowing the turbulence devices, in particular the turbulence fins, to be fitted, in particular shot, rapidly and cost effectively into waiting flow ducts for heat exchangers, in particular heat exchanger tubes.

According to the invention a turbulence device is furthermore provided, which is produced by a process and/or by an apparatus as disclosed herein, for a heat exchanger, in particular a charge air cooler and/or an exhaust gas cooler of a motor vehicle.

Further advantageous developments of the invention are set forth in the dependent claims and in the drawing. The subjects of the dependent claims relate both to the process according to the invention for producing a turbulence device and to the apparatus according to the invention for carrying out the process, and to the turbulence device according to the invention, in particular the turbulence fin.

BRIEF DESCRIPTION OF THE DRAWINGS

Exemplary embodiments of the invention are represented in the drawing and are explained in more detail below without there being any intention to limit the invention. In the drawing.

DETAILED DESCRIPTION

Figure 1A:
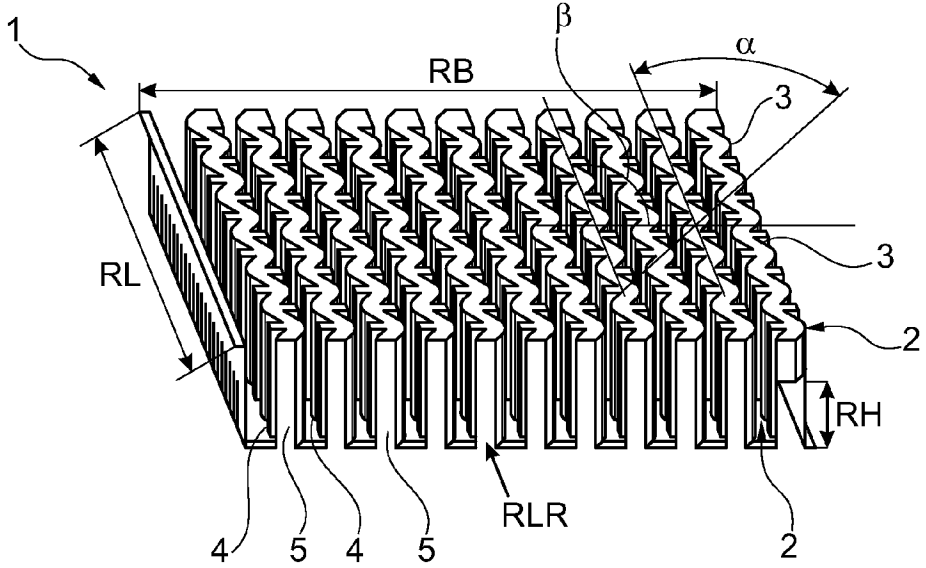
FIG. 1*a*: shows a turbulence device according to the invention, in particular a turbulence fin.

FIG. 1*a* shows a turbulence fin 1. The turbulence fin 1 has a fin width RB and a fin length RL. The turbulence fin 1 is of substantially meandering design and has a number of troughs 4, and correspondingly formed, associated peaks 5, a trough 4 in each case alternating with a peak 5.

The peak 5 is substantially a fin trough 4 turned through 180°. The fin troughs 4 and the fin peaks 5 have fin impressions 3, which are impressed into the fin peaks 5 and the fin troughs 4. Fin impressions substantially have a pyramidal shape, in particular the shape of a 4-sided pyramid or in another embodiment they may have a cuboidal shape. The fin peaks 5 and the fin troughs are defined by fin walls 2. Reference is made, with regard to the turbulence fin 1, to the unpublished DE 10 2007 014 138.8 by the present applicant, which is hereby expressly incorporated into the disclosure of this application. The turbulence fin 1 is formed from a metallic material, such as aluminum or steel, for example, such as special steel for example. The turbulence fin 1 may also be formed from another material which has a good thermal conductivity.

Figure 1B:
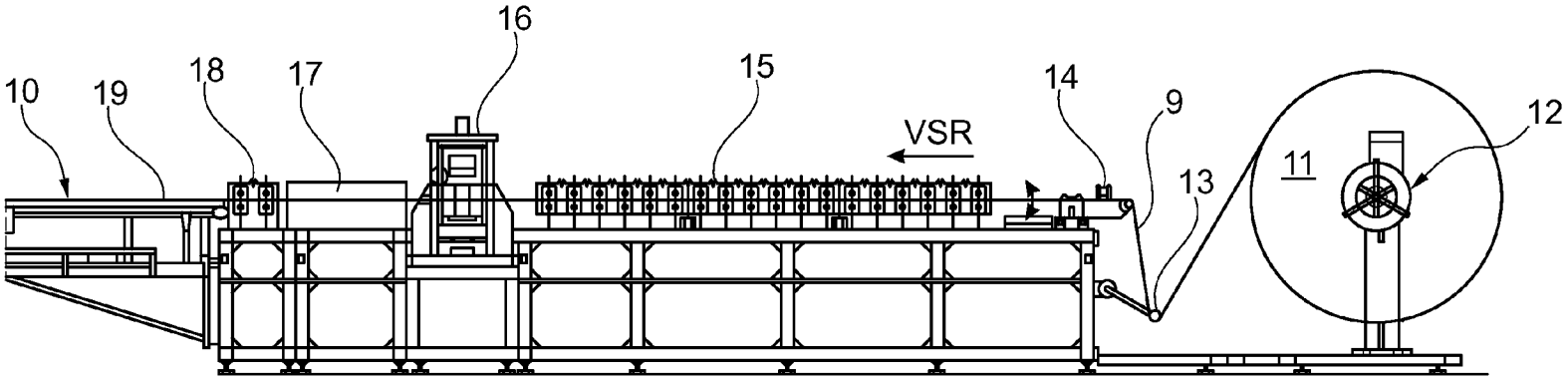
FIG. 1*b*: shows a side view of an apparatus for producing the turbulence fin.
Figure 2A:
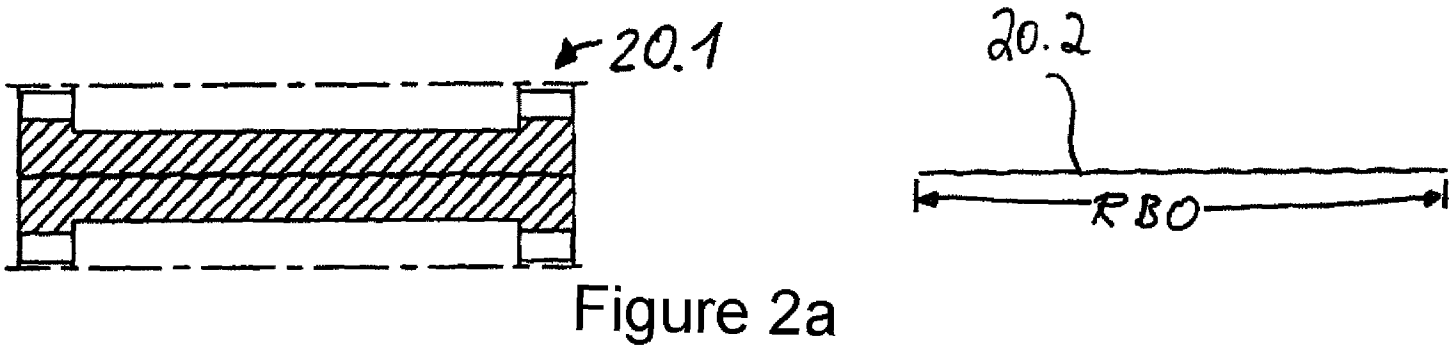
FIGS. 2*a*,2*b*,2*c* 2*d*,2*e*,2*f*,2*g*: show seven pairs of rollers and the sheared strips correspondingly shaped thereby.
Figure 2B:
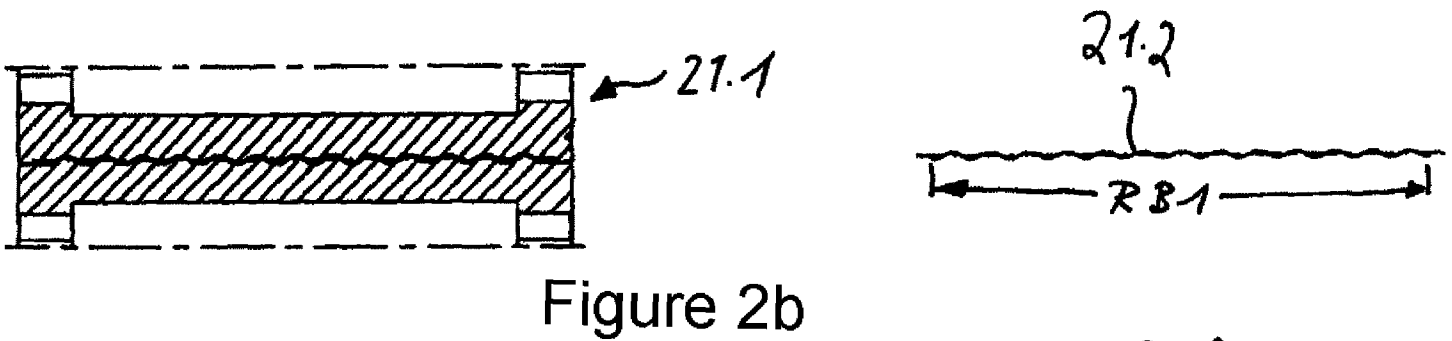
Figure 2C:
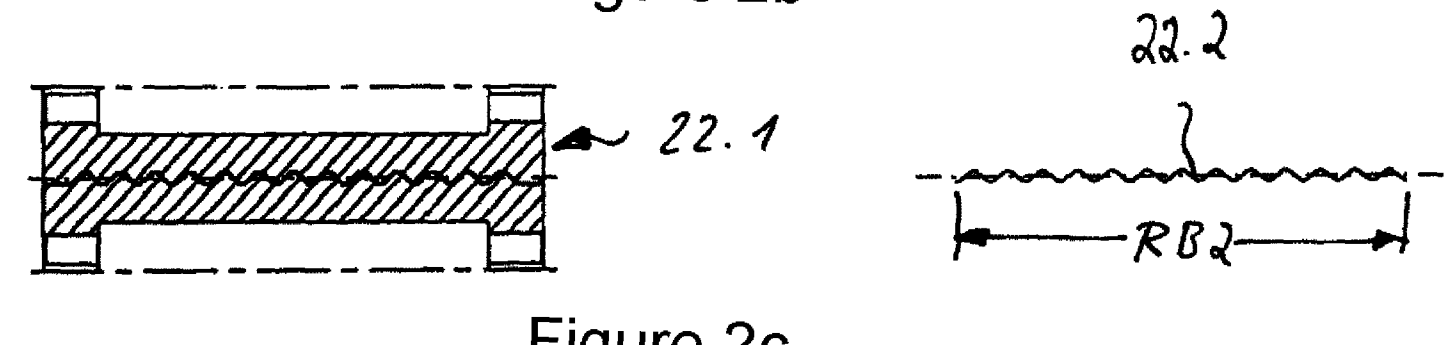
Figure 2D:
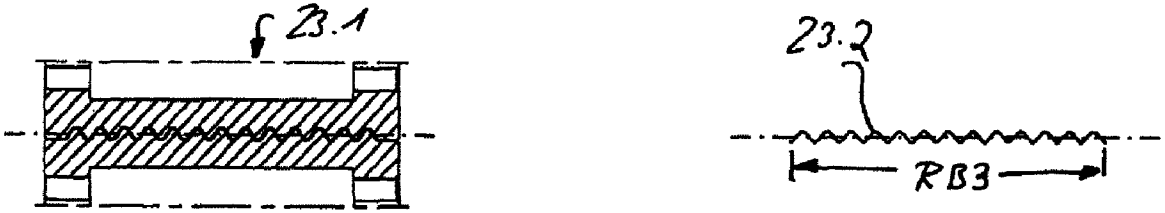
Figure 2E:
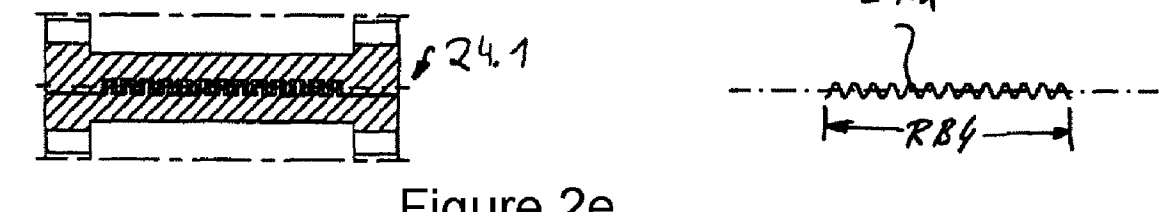
Figure 2F:
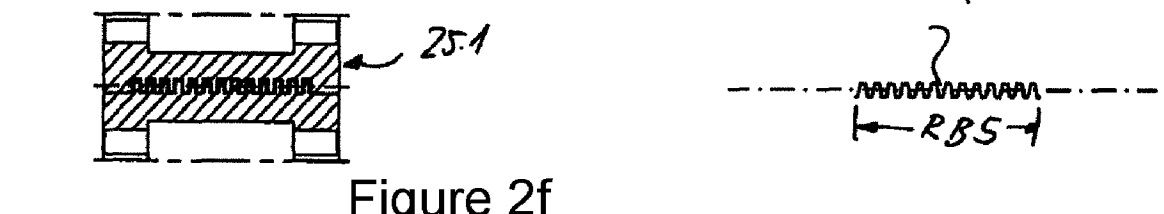
Figure 2G:
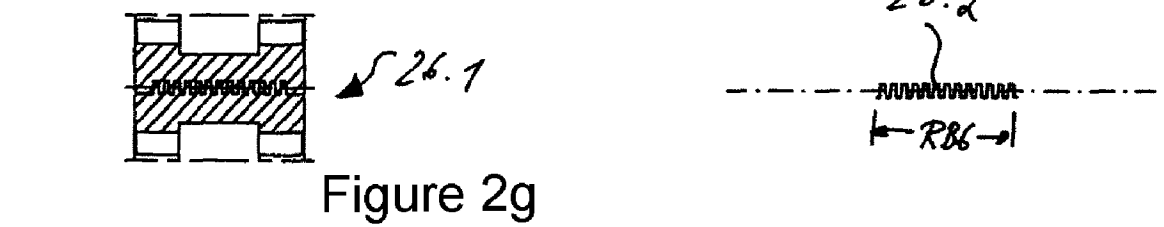

FIG. 1*b* shows a side view of an apparatus 10 for producing the turbulence fin 1. The same features are provided with the same reference numerals as in the preceding figures.

The apparatus 10 for producing the turbulence fin 1 has a take-off reel 12 with a coil 11. The coil 11 comprises the wound sheet-metal material. The apparatus 10 further comprises a dancer element 13, a strip inlet station 14, a number of pair of rollers 15, a station for cutting to length 16 and a station with roller stamping dies 18. Furthermore the apparatus 10 may additionally comprise a conveyor belt 19 and/or a transfer station 17 for transferring the strip material to the roller stamping die station 18 after cutting to length in the station 16.

The strip material is wound off from the take-off reel 12. The dancer element 13 means that the strip is always tensioned substantially uniformly as it is fed to the strip inlet station 14.

After feeding the sheet-metal material into the strip inlet station 14, the sheared strip is fed to the station 15 with the pairs of rollers. In the station 15 the pairs of rollers successively form the fin height RH of the turbulence fin 1 and successively give the fin troughs 4 and the fin peaks 5 the associated fin width RB, and after passing through the station 15 with the pairs of rollers the turbulence fin is formed as a smooth fin, in particular without the fin impressions 3. In the exemplary embodiment shown the station 15 has eighteen pairs of rollers. In another embodiment the station 15 has more than eighteen and in another embodiment fewer than 18 pairs of rollers.

In the station 16 the turbulence fins 1 are cut to the correspondingly required length. After cutting to the corresponding fin length RL the turbulence fin 1 does not yet have any fin impressions 3.

The turbulence fin 1 ready cut to length is fed to the station 18 with the roller stamping dies by means of the transfer station 17. In the station 18 cuts and the fin impressions 3 are finally introduced into the turbulence fin 1. Only after this operation does the turbulence fin 1 have the corresponding shape, as is represented in FIG. 1*a*. The turbulence fins 1 thus produced are fed by means of a conveyor belt and a feed device 19 to an assembly station, for fitting the fins into the flow ducts, for example, such as the heat exchanger tubes, for example.

FIGS. 2*a*, 2*b*, 2*c*, 2*d*, 2*e*, 2*f* and 2*g* show seven pairs of rollers 20.1 to 26.1 and the sheared strips 20.2 to 26.2 correspondingly shaped thereby. The same features are provided with the same reference numerals as in the preceding figures.

Figure 3:
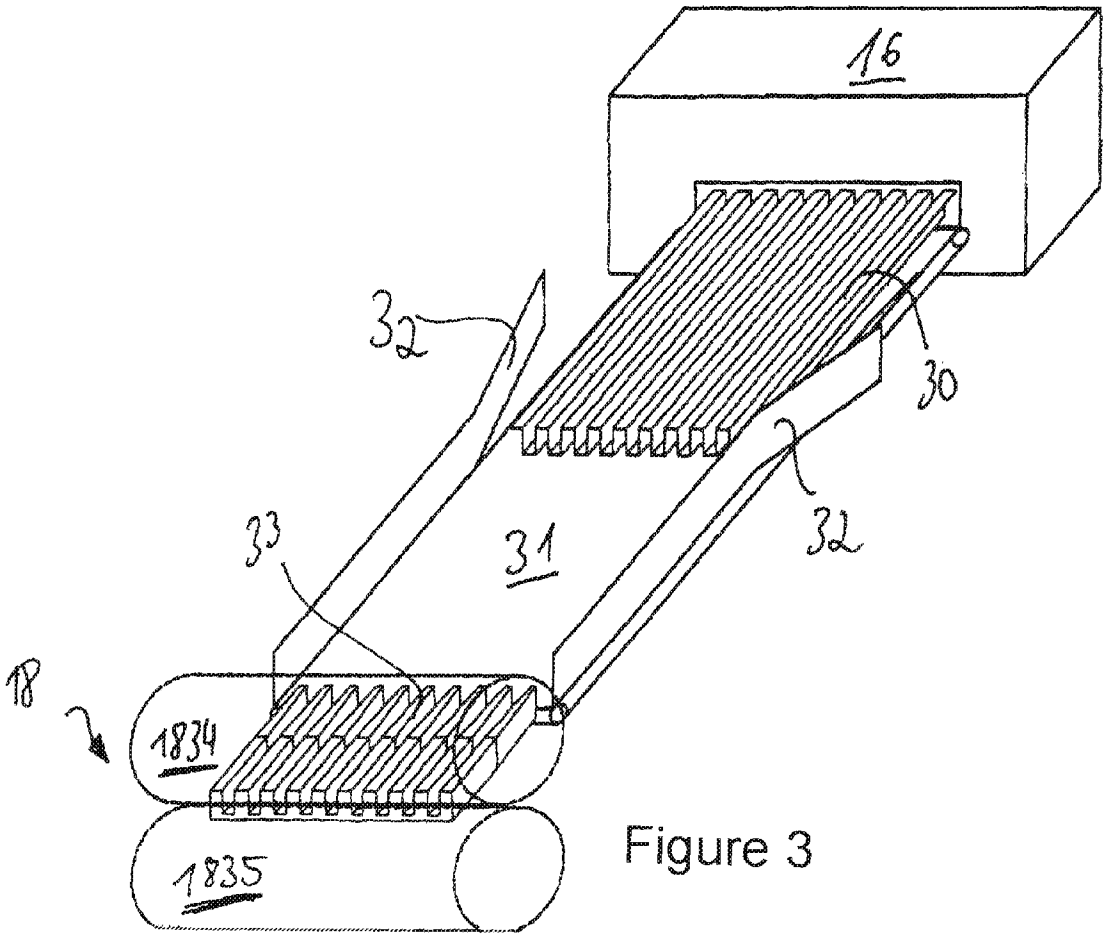
FIG. 3: shows a schematic, isometric representation of the cutting apparatus in the embodiment in which this is arranged between the pairs of rollers for producing the fins with smooth walls and on the inlet side of the roller stamping dies.

FIGS. 2*a* to 2*g* show how, starting from the sheared strip having the fin width RB0 of the sheet-metal strip 20.2, the fin width gradually diminishes over the steps 21.2. 22.2, 23.2, 24.2, 25.2 and 26.2, the fin width RB1 being less than the fin width RB0 and the fin width RB2 being less than the fin width RB1. The fin width RB3 is less than the fin width RB2 and the fin width RB4 is less than the fin width RB3. Likewise the fin width RB5 is less than the fin width RB4 and the fin width RB6 is less than the fin width RB5. The fin height RH, on the other hand, increases from the machining step 20.2 to the machining step 26.2. The associated pairs of rollers with the corresponding rollers 20.1, 21.1, 22.1, 23.1, 24.1, 25.1, 26.1 have the corresponding roller shapes in order to produce the associated fin preliminary stages. After the machining step 26.2 the result is a smooth fin, which does not yet have any fin impressions 3 or undercuts and indentations, however, FIG. 3 shows an isometric representation of the cutting apparatus 16 together with the conveyor belt 31 and the roller stamping dies 18. Once the smooth fin 30 has been cut to the correct length in the station for cutting to length 16 the smooth fin 30 thus produced is conveyed by a second conveyor belt 31 towards the guide elements 33. Guide baffle elements 32 here ensure that the smooth fin 30 is already roughly oriented. The inner guide element 33 serves for precise positioning and precise orientation of the smooth fin 30. The inner guide element 33 is of substantially comb-like design, in such a way that comb teeth substantially correspond to the shape of the fin peaks 5, so that the teeth elements (not more precisely denoted) can cause the inner guide element 33 to engage in the fin peaks 5. In this way precise positioning is performed before the smooth fin 30 is fed to the roller stamping die station 18 for further machining. A first roller stamping die 1834 and a second roller stamping die 1835, here represented schematically, interact and shape the smooth fin 30 in such a way that the fin impressions 3 and any cuts and other deformations are introduced into the smooth fin 30, thereby producing the finished turbulence fin 1. The roller stamping die station 18 and hence the introduction of the fin impressions 3 is in particular embodied in at least one pair of rollers, in particular in one to four pairs of rollers.

Figures 4A, 4B:
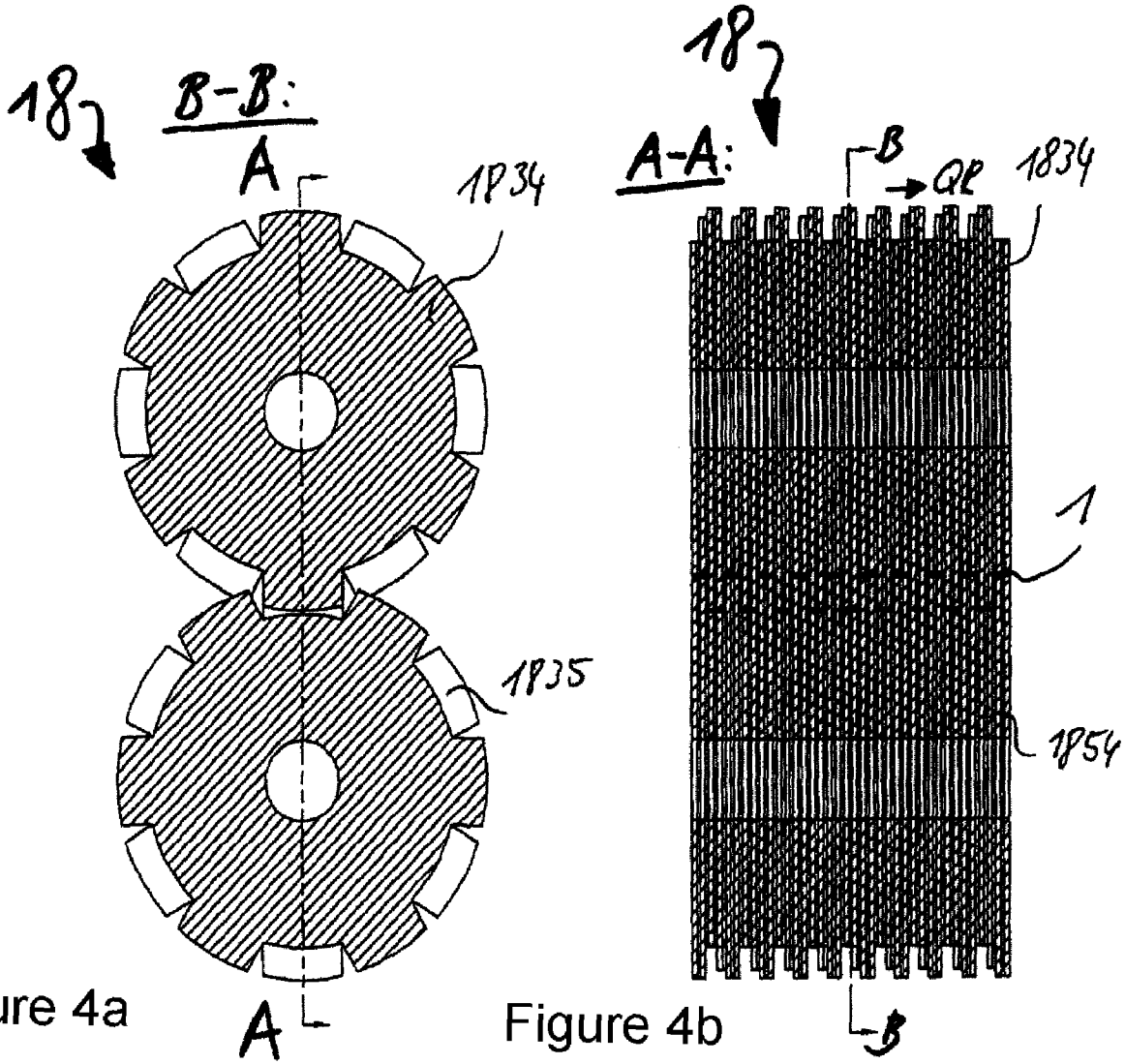
FIGS. 4*a*,4*b*: show roller stamping dies for introducing the cuts and undercuts or deformations.

FIGS. 4*a*, 4*b* show a sectional side view and a sectional front view. The same features are provided with the same reference numerals as in the preceding figures.

The roller stamping die station 18 comprises a first roller stamping die 1834 and a second roller stamping die 1835. The roller stamping die station 18 and therefore the introduction of the fin impressions 3 is, in particular, embodied by means of at least one pair of rollers, in particular by means of one to four pairs of rollers. Between the first roller stamping die 1834 and the second roller stamping die 1835 the smooth fin 30 produced is shaped into the finished turbulence fin 1. A sequence of first and second teeth, not further designated, means that the fin troughs 4 and the fin peaks 5 are offset in a transverse direction QR, which substantially has an angle $\alpha$ in relation to the fin longitudinal direction RLR. The angle $\alpha$ assumes values from 0° to 90°, in particular values from 0.5° to 80°. In this way the fin impressions 3, such as the offsets and/or indentations or the gills and/or the depth corrugations or the shapes of a similar nature are introduced into the smooth fin 30, so that the turbulence fin 1 is thereby produced.

Figure 5:
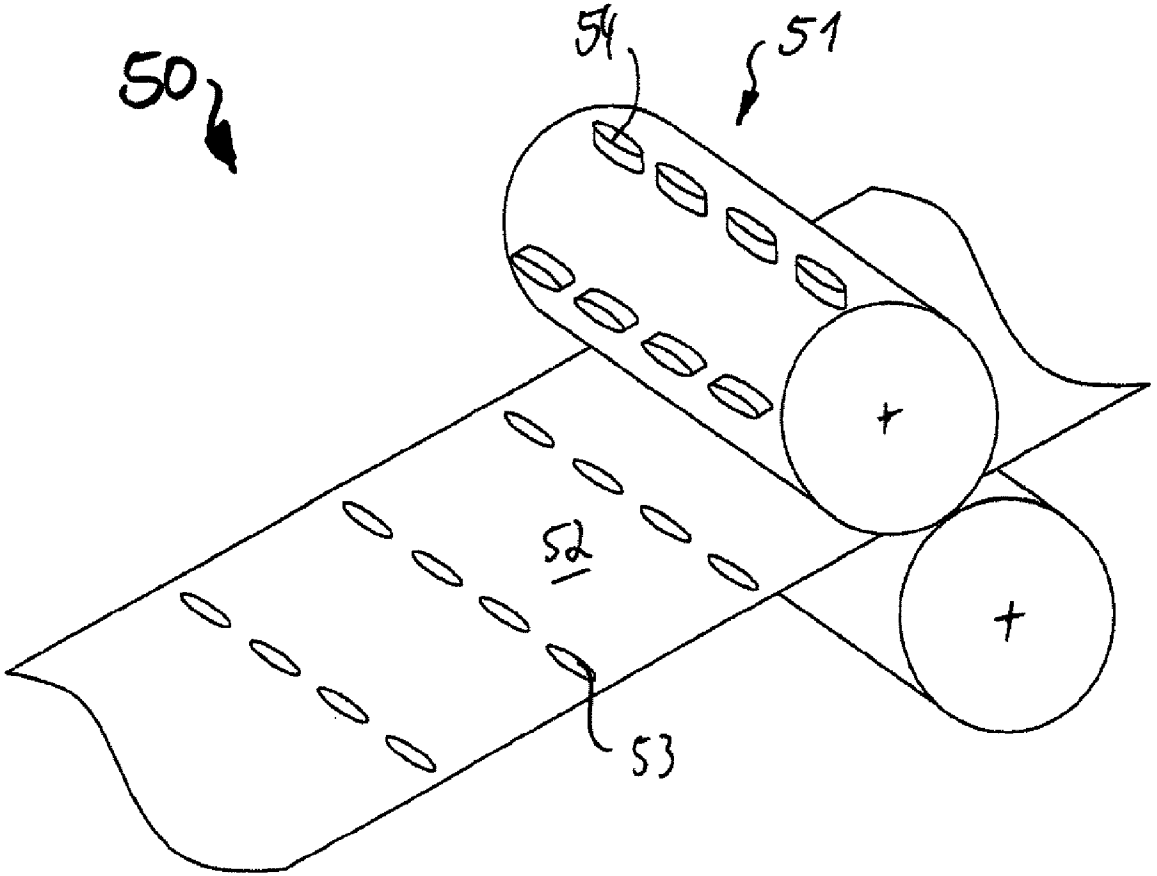
FIG. 5: shows a further machining station for introducing slits and stampings.

FIG. 5 shows a further machining station, which can be additionally activated. The same features are provided with the same reference numerals as in the preceding figures.

The additional machining station 50 is a rotary stamping or roller stamping station. It is connected to the inlet side of the roller set station 15. Thus the sheared strip, for example, after guiding and before production of the smooth fin 30 by stamping rollers 51, which comprise a plurality of punches 54, is machined in such a way that indentations 53 or open cuts or punched holes are already introduced into the sheared strip 52 before the production of the smooth fin 30.

Figure 6:
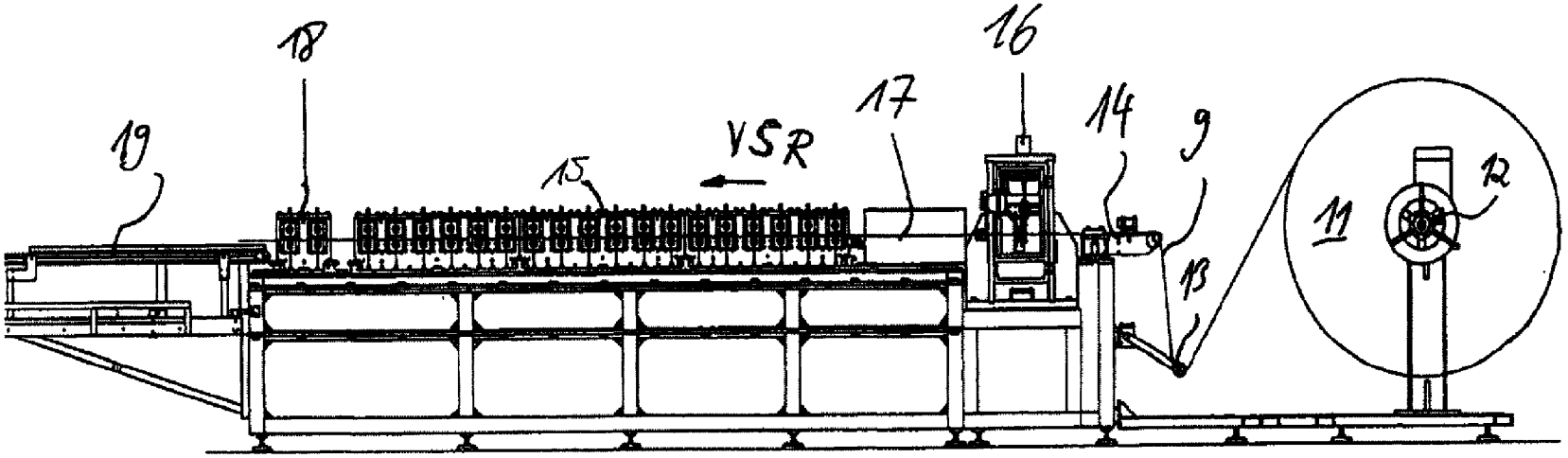
FIG. 6: shows a side view of another embodiment, wherein, in contrast to FIG. 1*b*, the station for cutting to length is arranged on the inlet side of the pairs of rollers.

FIG. 6 shows a side view of another working apparatus for producing the turbulence device 1 with another sequence of stations differing from FIG. 1*b*. The same features are provided with the same reference numerals as in the preceding figures.

In contrast to FIG. 1*b*, the sheared strip 9, after guiding in the strip inlet station 14, is cut to length in the station 16 and is then fed in the transfer station to the pair of rollers 15. In the pair of rollers 15 the smooth fin 30 is first produced. After producing the smooth fin 30 the finishing of the turbulence fin 1 is carried out substantially straight afterwards in the roller stamping dies 18. The turbulence fins 1 thus produced are fed via the first conveyor belt 19 to the assembly station, for example, for fitting in the heat exchangers.

In a development or alternative of the invention the process and/or the apparatus are used to produce longitudinally rolled internal fins, which combine one or more smooth areas with one or more areas having offsets and/or impressions and/or indentations and/or gills and/or depth corrugations. The roller stamping die is arranged, in particular, between the set of rollers for the smooth fin and the station 16 for cutting to length. The offsets and/or impressions and/or indentations and/or gills and/or depth corrugations can here be introduced in two ways:

In one development the roller stamping die is designed in such a way that it lifts off from the smooth fins and then only engages in the areas in which offsets and/or impressions and/or indentations and/or gills and/or depth corrugations are to be introduced.

In an alternative the offsets and/or impressions and/or indentations and/or gills and/or depth corrugations are arranged on the roller stamping die in such a way that multiple smooth areas are arranged over the circumference of the roller stamping die and the roller stamping die is here substantially in constant use.

In an advantageous development at least one internal corrugated fin is produced, which through a combination of smooth areas and areas with offsets and/or impressions and/or indentations and/or gills and/or depth corrugations or the like has a high efficiency for a lower pressure loss and which in addition is substantially easier to cut to length in the smooth areas.

The features of the various exemplary embodiments can be freely combined with one another. The invention can also be used in areas other than those shown.

The invention claimed is:

1. A process for producing a turbulence device (1) which is to be mounted in at least one flow duct of a heat exchanger of a motor vehicle, comprising the following process steps:

in a first process step, at least one shaping operation is used to produce at least one substantially meandering turbulence device (30) with substantially smooth walls (2) from a substantially continuously planar sheared strip (9), wherein a longitudinal direction (RLR) of the walls runs substantially parallel to a forward feed direction (VSR) of the sheared strip (9), in a second process step, wall sections are deformed at least by an angle ($\alpha$) in relation to the forward feed direction (VSR), in such a way that undercuts (3) are produced in relation to the forward feed direction (VSR, RLR), wherein the substantially continuously planar sheared strip (9) is cut into turbulence devices (1) of predetermined lengths before carrying out the second process step.

2. The process as claimed in claim 1, wherein at least one cut at an angle ($\beta$) is introduced into the meandering turbulence device (30) prior to the deformation of the wall sections.

3. The process as claimed in claim 2, wherein the angle ($\alpha$) and/or the angle ($\beta$) assume values from 0° to 90°.

4. The process as claimed in claim 3, wherein the angle ($\alpha$) and/or the angle ($\beta$) assume values of 0.5° to 80°.

5. The process as claimed in claim 1, wherein the first process step comprises 2 to 40 intermediate steps in which the sheared strip (9) is successively machined in such a way that the width (RB) of the substantially smooth turbulence device (30) thus produced has a smaller turbulence device width (RB) than in the preceding intermediate step.

6. The process as claimed in claim 5, wherein the intermediate steps are longitudinal rolling process steps.

7. The process as claimed in claim 5, wherein the first process step comprises 2 to 35 intermediate steps in which the sheared strip (9) is successively machined in such a way that the width (RB) of the substantially smooth turbulence device thus produced has a smaller turbulence device width (RB) than in the preceding intermediate step.

8. The process as claimed in claim 1, wherein cutting to length is performed prior to the first process step.

9. The process as claimed in claim 1, wherein cutting to length is performed between the first process step and the second process step.

10. The process as claimed in claim 1, wherein the first process step is a rolling process.

11. The process as claimed in claim 1, wherein the turbulence device (1, 30) has a sheet metal thickness from 0.05 mm to 0.35 mm.

12. The process as claimed in claim 1, wherein strip material for the sheared strip (9) is wound off from a coil (11) and is then led in such a way that the sheared strip (9) is substantially planar.

13. The process as claimed in claim 1, wherein the turbulence device (1, 30) has a sheet metal thickness from 0.05 mm to 0.25 mm.

14. The process as claimed in claim 1, wherein the turbulence device (1, 30) has a sheet metal thickness from 0.06 mm to 0.20 mm.

15. The process as claimed in claim 1, wherein the turbulence device (1, 30) has a sheet metal thickness from 0.06 mm to 0.15 mm.

* * * * *